US009016893B2

(12) United States Patent
Meng

(10) Patent No.: US 9,016,893 B2
(45) Date of Patent: Apr. 28, 2015

(54) LED LAMP

(71) Applicants: BOE Technology Group Co., Ltd., Beijing (CN); Beijing BOE Chatani Electronics Co., Ltd., Beijing (CN)

(72) Inventor: Yingli Meng, Beijing (CN)

(73) Assignees: BOE Technology Group Co., Ltd., Beijing (CN); Beijing BOE Chatani Electronics Co., Ltd, Beijing (CN)

( * ) Notice: Subject to any disclaimer, the term of this patent is extended or adjusted under 35 U.S.C. 154(b) by 0 days.

(21) Appl. No.: 14/051,676

(22) Filed: Oct. 11, 2013

(65) Prior Publication Data

US 2014/0104867 A1 Apr. 17, 2014

(30) Foreign Application Priority Data

Oct. 11, 2012 (CN) ..... 2012 1 0384633

(51) Int. Cl.
*F21S 4/00* (2006.01)
*F21K 99/00* (2010.01)
*F21V 17/00* (2006.01)

(52) U.S. Cl.
CPC . *F21K 9/52* (2013.01); *F21S 4/008* (2013.01); *F21V 17/002* (2013.01)

(58) Field of Classification Search
CPC . F21Y 2101/02; F21Y 2103/003; F21K 9/00; F21K 9/30; F21K 9/52; F21V 29/00; F21V 29/002; F21V 29/004; F21V 29/20; F21V 29/22
USPC ..... 362/235, 249.02, 219, 223, 218
See application file for complete search history.

(56) References Cited

U.S. PATENT DOCUMENTS

| | | | | |
|---|---|---|---|---|
| 6,874,924 | B1 * | 4/2005 | Hulse et al. | 362/551 |
| 2009/0147519 | A1 * | 6/2009 | Klipstein et al. | 362/249.02 |
| 2012/0008315 | A1 * | 1/2012 | Simon et al. | 362/217.13 |

FOREIGN PATENT DOCUMENTS

| | | | |
|---|---|---|---|
| CN | 1955814 | A | 5/2007 |
| CN | 101718407 | A | 6/2010 |
| CN | 201651946 | U | 11/2010 |
| CN | 101900273 | A | 12/2010 |
| CN | 102606956 | A | 7/2012 |
| CN | 102720972 | A | 10/2012 |

OTHER PUBLICATIONS

First office action and search report issued by Chinese Patent Office for priority application 201210384633.8 dated Feb. 14, 2014.
Second office action issued by Chinese Patent Office for priority application 201210384633.8 dated Sep. 25, 2014.

* cited by examiner

*Primary Examiner* — Thomas M Sember
(74) *Attorney, Agent, or Firm* — Frommer Lawrence & Haug LLP; Ronald R. Santucci

(57) ABSTRACT

The present invention provides a LED lamp with high brightness, a uniform light-emitting surface and good heat dissipation. The LED lamp includes a LED strip and a cylindrical light guide body connected to the LED strip, wherein light emitted from the LED strip irradiates towards the light guide body and exits via the surface of the light guide body.

9 Claims, 2 Drawing Sheets

LED LAMP

TECHNICAL FIELD

The present invention relates to the field of illumination technology, and more particularly relates to a LED (Light Emitting Diode) lamp having high brightness, uniform light-emitting surface and good heat dissipation.

BACKGROUND ART

LED lamps are more and more widely used in the illumination field due to their low-carbon, environment-friendly, long operating life characteristics etc. In the current market, a LED lamp is configured to fix a plurality of LEDs on a lamp panel above which a heat-dissipating cover and a light-transmitting cover are provided. The plurality of LEDs will lead to heat-dissipating problems which are difficult to deal with, and a lot of heat build-up may result in hidden danger of heat dissipation. In addition, the arrangement of the plurality of LEDs may cause a non-uniform light-emitting surface, which will result in the fact that shadows of the LEDs can be seen.

In the existing side LED backlight module, the light guide plate is optically designed such that light emitted from LEDs can bring about images of more uniform brightness at the light-exiting surface of the light guide plate. That is, the backlight surface of the light guide plate is designed with regular light guide grid-dots for regulating the light. However, the volume of the LED lamp implemented by using the light guide plate is small, which results in the fact that it is difficult to optically distribute the grid-dots. That is, it is difficult to obtain a uniform brightness distribution on the entire light-exiting surface of the light guide plate.

In order to solve the above problems, the present invention makes a beneficial improvement.

SUMMARY

Technical Problems to be Solved

An object of the present invention is to provide a LED lamp which can effectively improve the light efficiency and has a uniform brightness distribution on the entire light-emitting surface.

Technical Solutions

The present invention is achieved in the following technical solution: a LED lamp, including a LED strip and a cylindrical light guide body connected to the LED strip, wherein light emitted from the LED strip irradiates toward the light guide body and exits via the surface of the light guide body.

The LED lamp further includes a light guide connection plate arranged at a side of the light guide body and provided with a recess, and the LED strip is embedded in the recess.

Further, the recess is in parallel with the light guide body, and the light-emitting surface of the LED strip faces the light guide body.

The LED strip includes a plurality of LEDs provided thereon, and the plurality of LEDs are arranged in a line and equally spaced therebetween.

Further, LEDs at both ends of the LED strip are arranged to respectively slant towards the end surfaces of the light guide body close to them.

Still further, the LED strip further includes a plurality of divider resistors provided thereon, and each LED of the LED strip and a divider resistor are connected in series.

In addition, the LED lamp further includes a L-shaped backplate, and the LED strip is adhered to the inner surface of one side plate of the L-shaped backplate, wherein the one side plate is embedded in the recess of the light guide connection plate, and the other side plate of the L-shaped backplate is arranged outside the light guide connection plate.

Material of the L-shaped hackplate includes aluminum.

Further, the LED strip is adhered to the L-shaped backplate by heat-dissipating adhesive.

Moreover, the LED lamp further includes a driving power supply provided on the outer surface of the L-shaped backplate outside the light guide connection plate.

In addition, material of the light guide body includes polymethyl methacrylate (PMMA).

Beneficial Effects

Compared to the existing technologies and products, the present invention provides following advantages:

1. In the present invention, by providing the LED strip at a side of the light guide body and guiding out the light emitted from the LED strip by the light guide body, in the case that the same lighting effect is required, the number of the LEDs required is significantly reduced; By providing a cylindrical light guide body and arranging the two LEDs at both ends of the LED strip slant towards the end surfaces of the light guide body close to them, a uniform brightness can be achieved on the entire light-emitting surface of the light guide body of the LED lamp;
2. The present invention provides a better way to solve the heat-dissipating problem of the LED lamp;
3. With the structure of the light guide connection plate provided with a recess, the LED lamp provided by the present invention is better in light efficiency and the volume thereof is smaller;
4. By providing the driving power supply of the LED strip on the aluminum backplate and outside the lamp tube (i.e. the light guide body), the driving power supply operates safely and a light-emitting surface with uniform brightness is obtained.

REFERENCE NUMERALS

1, light guide connection plate;
2, L-shaped backplate;
3, light guide body
4, LED strip
41, LED
42, divider resistor
5, driving power supply

DETAILED DESCRIPTION OF THE PREFERRED EMBODIMENTS

Hereafter, embodiments of the present invention will be described in detail in conjunction with the accompanying drawings.

Figure 1:
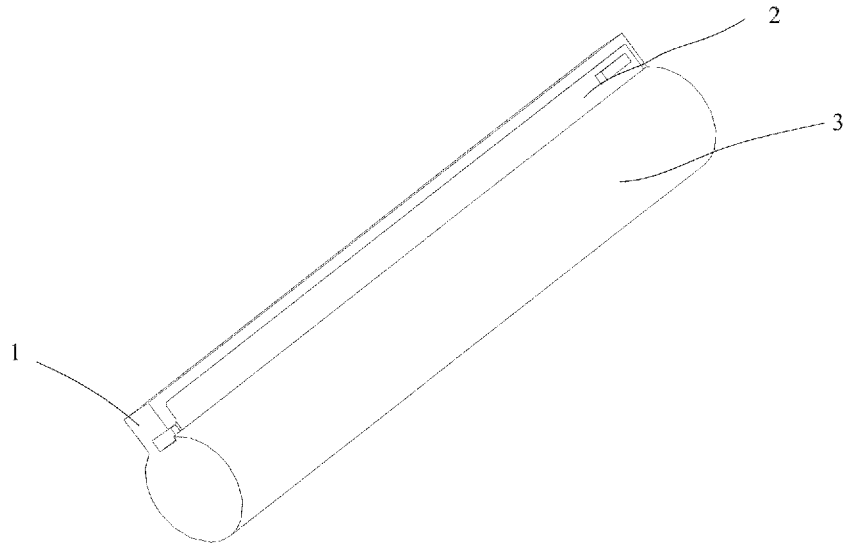
FIG. 1 is a diagram of a whole structure of a LED lamp according to an embodiment of the present invention.
Figure 2:
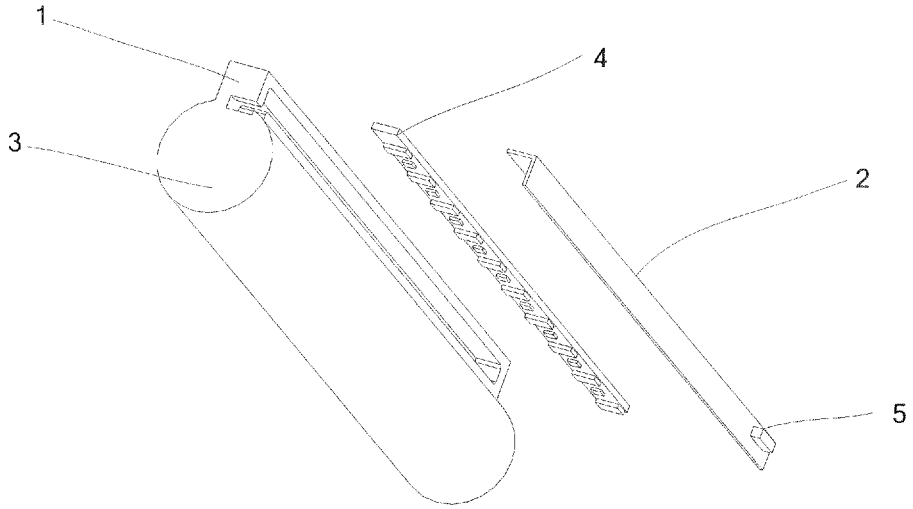
FIG. 2 is a schematic view of connections in the assembled structure of a LED lamp according to an embodiment of the present invention.

FIG. 1 is a diagram of a whole structure of a LED lamp according to an embodiment of the present invention. FIG. 2 is a diagram of connections in the assembled structure of a LED lamp according to an embodiment of the present invention.

As shown in FIGS. 1 and 2, a LED lamp according to an embodiment of the present invention includes a light guide connection plate 1, an L-shaped backplate 2, a light guide body 3, a LED strip 4 and a driving power supply 5.

Specially, the LED strip 4 is detachably or fixedly connected to the light guide body 3. The light guide body 3 is cylindrical. Light emitted from the LED strip 4 will irradiate towards the light guide body 3 and exit via the surface of the light guide body 3.

In the present embodiment, as the light guide body 3 is cylindrical, the path of the light emitted from the LED lamp can be regulated effectively and the light-exiting angle will be changed, thereby lighting effect of high brightness and good uniformity can be achieved.

The LED strip 4 can be arranged at a side of the light guide body 3 in numerous connecting ways (such as by using adhesive, by mounting bracket or support plate), and emits light towards the light guide body 3.

Preferably, the LED strip 4 is arranged at a side of the light guide body 3 in an embedded manner. As shown in FIG. 2, the light guide connection plate 1 is arranged at a side of the light guide body 3 and is provided with a recess. The recess is in parallel with the light guide body 3, so that after the LED strip 4 is inserted into the recess of the light guide connection plate 1, the LED strip 4 can emit light towards the light guide 3 through the light guide connection plate that is, the light-emitting surface of the LED strip 4 faces the light guide body 3. The light guide body 3 and the light guide connection plate 1 are formed as an integral structure.

With the light guide connection plate 1 provided with a recess, the LED lamp itself will be more compact, durable and of smaller volume while light efficiency of the LED lamp will be improved.

Of course, the LED strip 4 can also be adhered to a backplate, and the backplate is then inserted into the recess of the light guide connection plate 1. The shape of the backplate can be determined in accordance with the actual requirements by a skilled person in the art. In the present embodiment, preferably, the backplate is implemented as an L-shaped backplate 2, and material with good heat dissipation (such as aluminum) is selected as material of the L-shaped backplate 2. The LED strip 4 is adhered to the inner surface of one side plate of the L-shaped backplate 2, which is embedded in the recess of the light guide connection plate and the other side plate of the L-shaped backplate 2 is provided outside the light guide connection plate 1. As surface area of the L-shaped backplate 2 is large, and the one side plate of the L-shaped backplate 2 (to which the LED strip 4 is adhered) is embedded in the recess of the light guide connection plate 1 while the other side plate of the L-shaped backplate 2 is provided outside the light guide connection plate 1, the heat dissipation of the LED strip 4 will be better. In order to ensure the heat-dissipating effect, the LED strip 4 is adhered to the L-shaped backplate 2, and it is best to use heat-dissipating adhesive (i.e. thermally conductive silicone) to adhere.

Preferably, light guide material with good light transmission for the light emitted from the LED strip is selected as material of the light guide connection plate 1. In the present embodiment, preferably, PMMA (polymethy) methacrylate) material is used. Light transmission of PMMA material for the white light is up to 92%. In addition, product of PMMA material has low birefringence, good transparency, and prominent ageing stability.

Figure 3:
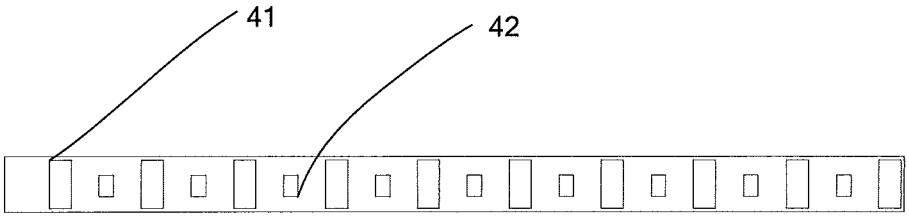
FIG. 3 is a diagram of the structure of a LED strip of a LED lamp according to an embodiment of the present invention.
Figure 4:
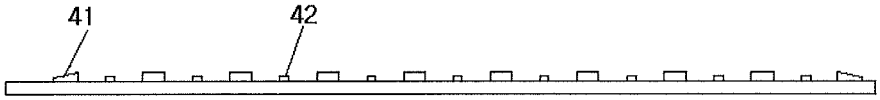
FIG. 4 is a side view diagram of the structure of a LED strip of a LED lamp according to an embodiment of the present invention.

FIG. 3 is a diagram of the structure of the LED strip of a LED lamp according to an embodiment of the present invention.

As shown in FIG. 3, the LED strip 4 is provided with a plurality of LEDs 41, and the LEDs 41 are arranged in a line. If the LED strip 4 includes more than three LEDs 41, adjacent LEDs 41 are equally spaced therebetween, which can ensure uniform brightness of light emitted from the LED strip 4.

The LED strip 4 can be driven by a constant voltage. By providing several divider resistors 42 on the LED strip 4 and ensuring that each LED 41 and a divider resistor 42 are connected in series, in the case that the rating driving voltage of each LED 41 is satisfied, the voltage can be divided. By dividing the voltage using the divider resistors, the light-emitting brightness of the LEDs 41 will be uniformly distributed. In addition, as to the LEDs 41 at both ends of the LED strip 4, each LED 41 is arranged to slant towards the end surface of the light guide body 3 close to it. Higher power LEDs can be provided at both ends of the LED strip 4 to improve the light-emitting effect at both ends of the cylindrical light guide body 3, so that there is no shadow on the entire surface of the light guide body 3 and a surface with uniform brightness can be achieved.

As shown in FIG. 2, the driving power supply 5 of the LED strip 4 is provided on the outer surface of the L-shaped backplate 2 outside the light guide connection plate 1, and the driving power supply 5 is connected to electrodes at both ends of the LED strip 4 or the lamp tube. Thereby, on the one hand, the driving power supply 5 has good heat dissipation and can operate safely; and on the other hand, the driving power supply 5 will not block the light emitted from the LED strip to cause shadow on part of the light-emitting surface.

Obviously, person skilled in the art can make various modifications and variations without departing from the spirit and the scope of the invention. The present invention is intended to include these modifications and variations if these modifications and variations belong to the scope of the claims and their equivalents.

The invention claimed is:

1. A LED lamp, characterized in that, including a LED strip, a cylindrical light guide body, a light guide connection plate arranged at a side of the light guide body and provided with a recess, and a L-shaped backplate, wherein the LED strip is adhered to an inner surface of a first side plate of the L-shaped backplate which is embedded in the recess of the light guide connection plate, and a second side plate of the L-shaped backplate is arranged outside the light guide connection plate, light emitted from the LED strip irradiates towards the light guide body and exits via a surface of the light guide body.

2. The LED lamp according to claim 1, characterized in that, the recess is in parallel with the light guide body, and light-emitting surface of the LED strip faces the light guide body.

3. The LED lamp according to claim 1, characterized in that, the LED strip includes a plurality of LEDs provided thereon, and the plurality of LEDs are arranged in a line and equally spaced therebetween.

4. The LED lamp according to claim 3, characterized in that, LEDs at both ends of the LED strip are arranged to respectively slant towards end surfaces of the light guide body close to them.

5. The LED lamp according to claim 3, characterized in that, the LED strip further includes a plurality of divider resistors provided thereon, and each LED on the LED strip and one divider resistor are connected in series.

6. The LED lamp according to claim 1, characterized in that, material of the L-shaped backplate includes aluminum.

7. The LED lamp according to claim 1, characterized in that, the LED strip is adhered to the L-shaped backplate by heat-dissipating adhesive.

8. The LED lamp according to claim 1, characterized in that, further including a driving power supply provided on an outer surface of the L-shaped backplate outside the light guide connection plate.

9. The LED lamp according to claim 1, characterized in that, material of the light guide body includes polymethyl methacrylate (PMMA).

* * * * *